US008919460B2

(12) United States Patent
Joulin et al.

(10) Patent No.: US 8,919,460 B2
(45) Date of Patent: Dec. 30, 2014

(54) LARGE CORE SIDEWALL CORING

(75) Inventors: Sebastien Joulin, Houston, TX (US); Stephen Yeldell, Sugar Land, TX (US); Brandon Christa, Houston, TX (US); James Massey, Longview, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 168 days.

(21) Appl. No.: 13/609,748

(22) Filed: Sep. 11, 2012

(65) Prior Publication Data

US 2013/0068531 A1 Mar. 21, 2013

Related U.S. Application Data

(60) Provisional application No. 61/535,442, filed on Sep. 16, 2011.

(51) Int. Cl.
*E21B 49/02* (2006.01)
*E21B 4/02* (2006.01)
*E21B 49/06* (2006.01)

(52) U.S. Cl.
CPC .. *E21B 4/02* (2013.01); *E21B 49/06* (2013.01)
USPC ..... 175/78; 175/20; 175/58

(58) Field of Classification Search
CPC ..... E21B 4/02; E21B 49/06
USPC ..... 175/78, 77, 44, 248, 249, 332, 333, 175/403, 404, 20; 166/100, 191, 259, 264
See application file for complete search history.

(56) References Cited

U.S. PATENT DOCUMENTS 4,449,593 A 5/1984 Jageler et al.
4,714,119 A * 12/1987 Hebert et al. ..... 175/20
4,981,183 A 1/1991 Tibbitts (Continued)

FOREIGN PATENT DOCUMENTS

EA 011911 B1 6/2009
EP 0224408 A2 6/1987
WO 2009155268 A2 12/2009
WO 2011044427 A2 4/2011

OTHER PUBLICATIONS

International Search Report and Written Opinion dated Nov. 29, 2012 for corresponding International Application No. PCT/US2012/054746 (7 pages).

(Continued)

*Primary Examiner* — Yong-Suk (Philip) Ro
(74) *Attorney, Agent, or Firm* — Cathy Hewitt

(57) ABSTRACT

A coring tool having a coring mechanism for cutting cores from a borehole sidewall. The coring mechanism comprises a motor having a coring bit to cut 1.5 inch diameter, 2.5 inch long cores. Support plates fixed to the housing comprise guide slots having a longer leg and a shorter leg. Leading pins and follower pins extend from the motor into the guide slots. When the leading and follower pins are driven along the guide slots, the motor is rotated and then pushed into the formation. Drive plates positioned between the housing and the support plates comprise slots and pivot about a pin. The leading pins further extend into the drive plate slots. A hydraulic cylinder pivots the drive plates, pushing the pins along the guide slots to rotate the motor to a radial position and then urge the motor towards the formation.

20 Claims, 8 Drawing Sheets

(56) References Cited

U.S. PATENT DOCUMENTS

| | | | |
|---|---|---|---|
| 5,310,013 | A | 5/1994 | Kishino et al. |
| 5,411,106 | A | 5/1995 | Maissa et al. |
| 5,617,927 | A | 4/1997 | Maissa |
| 5,667,025 | A | 9/1997 | Haessly et al. |
| 6,371,221 | B1 | 4/2002 | Harrigan et al. |
| 6,412,575 | B1 | 7/2002 | Harrigan et al. |
| 6,729,416 | B2 | 5/2004 | Contreras et al. |
| 7,191,831 | B2 | 3/2007 | Reid et al. |
| 7,193,525 | B2 | 3/2007 | Miyamae et al. |
| 7,259,689 | B2 | 8/2007 | Hernandez-Marti et al. |
| 7,373,994 | B2 | 5/2008 | Tchakarov et al. |
| 7,431,107 | B2 | 10/2008 | Hill et al. |
| 7,530,407 | B2 | 5/2009 | Tchakarov et al. |
| 7,762,328 | B2 | 7/2010 | Tchakarov |
| 7,787,525 | B1 | 8/2010 | Clark, Jr. et al. |
| 7,958,936 | B2 | 6/2011 | McGregor et al. |
| 7,987,901 | B2 | 8/2011 | Krueger et al. |
| 8,171,990 | B2 | 5/2012 | Tchakarov et al. |
| 8,210,284 | B2 | 7/2012 | Buchanan et al. |
| 2011/0174543 | A1 | 7/2011 | Walkingshaw et al. |

OTHER PUBLICATIONS

English abstract of Eurasian Publication No. EA011911(B1) (2 pages).

* cited by examiner

LARGE CORE SIDEWALL CORING

CROSS-REFERENCE TO RELATED APPLICATIONS

This application claims the benefit of U.S. Provisional Application No. 61/535,442, entitled "Large Core Sidewall Coring," filed Sep. 16, 2011, the entire disclosure of which is hereby incorporated herein by reference.

BACKGROUND OF THE DISCLOSURE

Wellbores or boreholes may be drilled to, for example, locate and produce hydrocarbons. During a drilling operation, it may be desirable to evaluate and/or measure properties of encountered formations, formation fluids and/or formation gasses. An example property is the phase-change pressure of a formation fluid, which may be a bubble point pressure, a dew point pressure and/or an asphaltene onset pressure, depending on the type of fluid, in some cases, a drillstring is removed and a wireline tool is deployed into the wellborn to test, evaluate and/or sample the formation, formation gas and/or formation fluid. In other cases, the drillstring may be provided with devices to test and/or sample the surrounding formation, formation gas and/or formation fluid without having to remove the drillstring from the wellbore. Some formation evaluations may include extracting a core sample from the sidewall of a wellbore using a hollow coring bit. Testing/analysis of the extracted core may then be performed downhole and/or at the surface to assess the formation from which the core sample was extracted.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
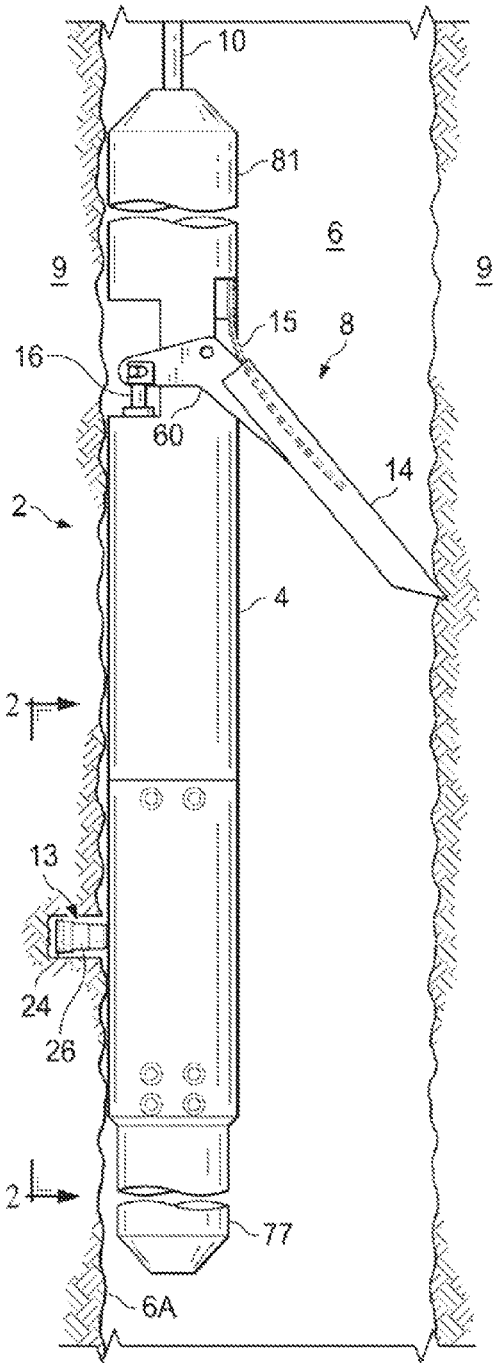
FIG. 1 is a schematic side view of at least a portion of apparatus according to one or more aspects of the present disclosure.

Certain examples are shown in the above-identified figures and described in detail below. The figures are not necessarily to scale and certain features and certain views of the figures may be shown exaggerated in scale or in schematic for clarity and/or conciseness, it is to he understood that while the present disclosure provides many different embodiments or examples for implementing different features of various embodiments, other embodiments may be implemented and/or structural changes may be made without departing from the scope of the present disclosure. Further, while specific examples of components and arrangements are described below, these are merely examples and are not intended to be limiting. In addition, the present disclosure may repeat reference numerals and/or letters in the various examples. This repetition is for the purpose of clarity and does not in itself dictate a relationship between the various embodiments and/or example configurations discussed. Moreover, the depiction of a first feature over or on a second feature in the present disclosure may include embodiments in which the first and second elements are implemented in direct contact, and may also include embodiments in which other elements may be interposed between the first and second elements, such that the first and second elements need not be in direct contact.

Figure 2:
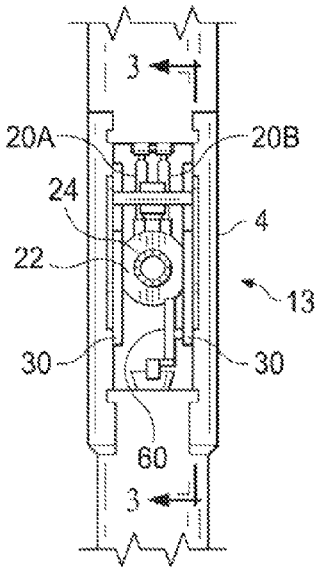
FIG. 2 is a schematic front view of a portion of the apparatus shown in FIG. 1.

FIGS. 1 and 2 are schematic side and front views, respectively, of at least a portion of a coring tool apparatus 2 according to one or more aspects of the present disclosure. The coring tool apparatus 2 includes an elongate housing 4 containing an anchoring mechanism 8 for securing the coring tool apparatus 2 at a desired position relative to a borehole 6 drilled through a subterranean formation 9. The coring tool apparatus 2 also includes a core drilling mechanism for cutting cores from the sidewall 6A of the borehole 6. The housing 4 is configured for coupling with means for conveyance, such as a wireline 10 and/or other conveyance means, to transport the coring tool, apparatus 2 within the borehole 6 and, perhaps, to connect the coring tool apparatus 2 for communication with suitable power sources and above-ground controls.

Figure 3A:
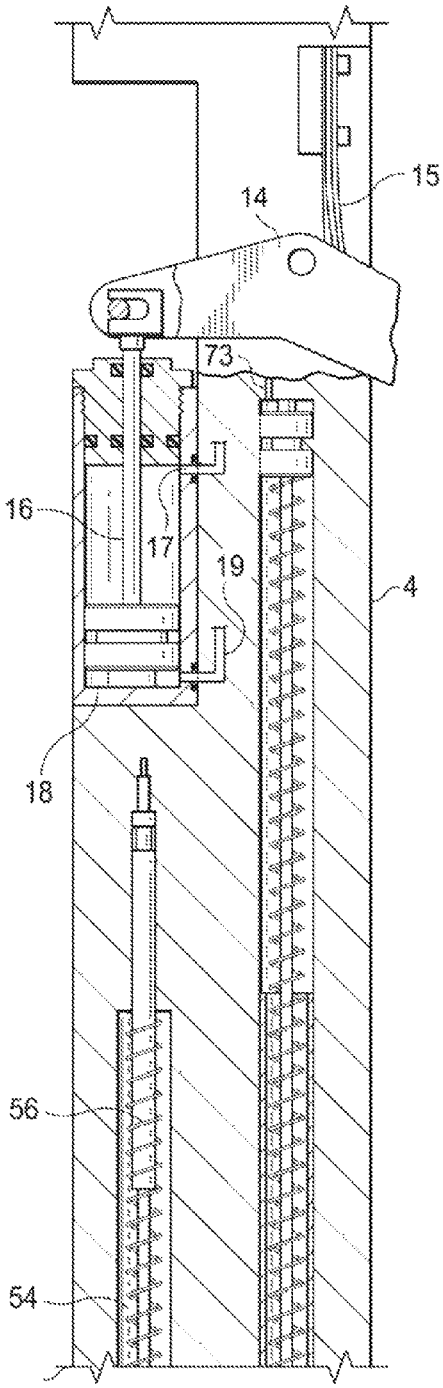
FIGS. 3A and 3B are collectively a schematic sectional side view of a portion of the apparatus shown in FIG. 1.

As shown in FIGS. 1 and 3A, the anchoring mechanism 8 may comprise an L-shaped anchoring shoe 14 pivotally attached at its vertex to the housing 4 for movement toward and away from the side of the housing 4 opposite the core drilling mechanism 13. The anchoring shoe 14 lies flush against the housing 4 while the coring tool apparatus 2 is conveyed along the borehole 6. When the coring tool apparatus 2 is at the desired position (e.g., depth, and/or azimuth within the borehole 6), the anchoring shoe 14 may be pivoted to an extended position by actuation of a hydraulic ram 16 coupled thereto. When the ram 16 retracts into its associated cylinder 18, the anchoring shoe 14 is extended away from the housing 4 to engage the side 6A of the borehole 6, holding the core drilling mechanism 13 firmly against die side 6A in the desired position. Extension of the ram 16 from the cylinder 18 retracts the anchoring shoe 14 toward the housing 4. A spring 15 mounted between the housing 4 and shoe 14 may automatically retract the anchoring shoe 14, should the hydraulic cylinder 16 fail to operate. Any suitable arrangement for pressurizing the cylinder 18 to effect, the desired, movement of the ram 16 may be used, such as the provision of hydraulic line inlets 17, 19 to both ends of the cylinder 18, as shown in FIG. 3A. Here, as is the case throughout the figures, hydraulic lines are not shown in their entirety for clarity of illustration.

Referring to FIGS. 2, 3B and 4-6, the core drilling mechanism 13 includes a hydraulic coring motor 22 which is connected by lines 20A, 20B to a hydraulic power supply (not shown). The hydraulic coring motor 22 has a hollow shaft, from, which a coring bit 24 on the end of a core-retaining sleeve 26 extends. The coring bit 24, which may be a diamond bit, may be capable of cutting a core of at least about 1.5 inches in diameter, and the sleeve 26 may be capable of holding a core of at least about 2.5 inches in length. The sleeve 26 may alternatively, or additionally, be capable of holding a core of at least about 3.0 inches in length, and/or about 3.5 inches in length, perhaps still with a diameter of at least about 1.5 inches. To allow the hydraulic coring motor 22 to fit entirely within the housing 4 in its vertical stowed position, the hydraulic coring motor 22 may have a transverse dimension smaller than the diameter of the housing 4.

Figure 3B:
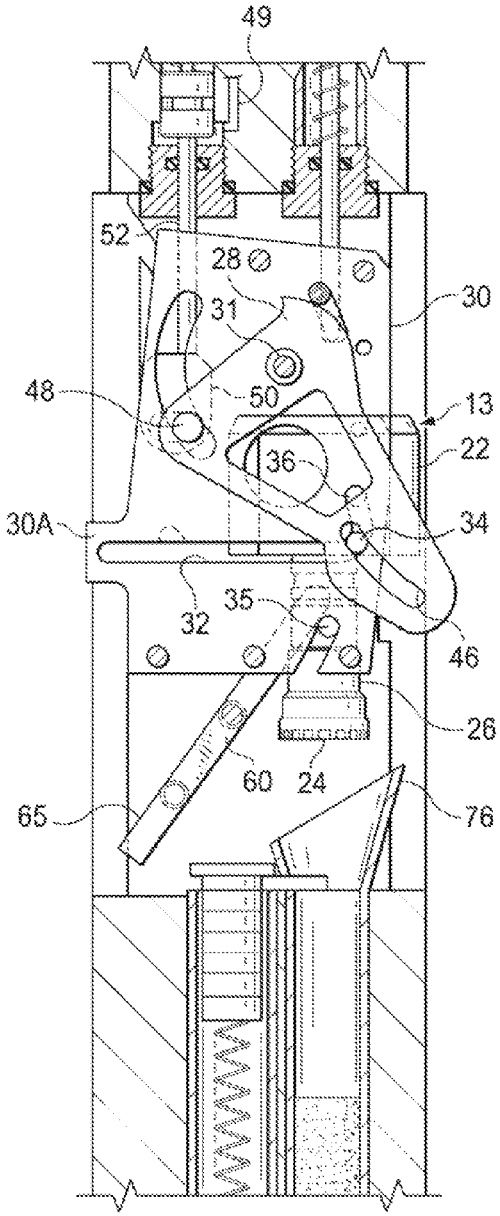

Two pins 34, 36 extend from each side of the hydraulic coring motor 22 on a line perpendicular to the axis of the hydraulic coring motor 22. The hydraulic coring motor 22 is supported by the pins 34, 36 between a pair of support plates 30 which are fixedly mounted to the housing 4. Each of the fixed support plates 30 has a J-shaped guide slot 32 (also referred to herein as J-shaped slot 32 and J-slot 32) in which the pins 34, 36 are engaged. As shown in FIG. 3B, the J-shaped slot 32 has its longer leg disposed in a perpendicular direction relative to the central axis of the coring tool apparatus 2, with its shorter leg extending almost perpendicular to the longer leg. However, the shorter leg may extend from, the longer leg at an angle ranging between about 70 degrees and about 110 degrees relative to the direction in which the longer leg extends. Similarly, the spacing and positioning of the pins 34, 36 and the dimensions and shape of the J-slot 32 may vary within the scope of the present disclosure. In any case, however, such spacing, positioning, dimensions and shape may be chosen so that when the pin 36 is at the end of the shorter leg, the coring bit 24 points in a direction generally parallel with the axis of the coring tool apparatus 2, as shown in FIGS. 3B, 4 and 5.

Figure 4:
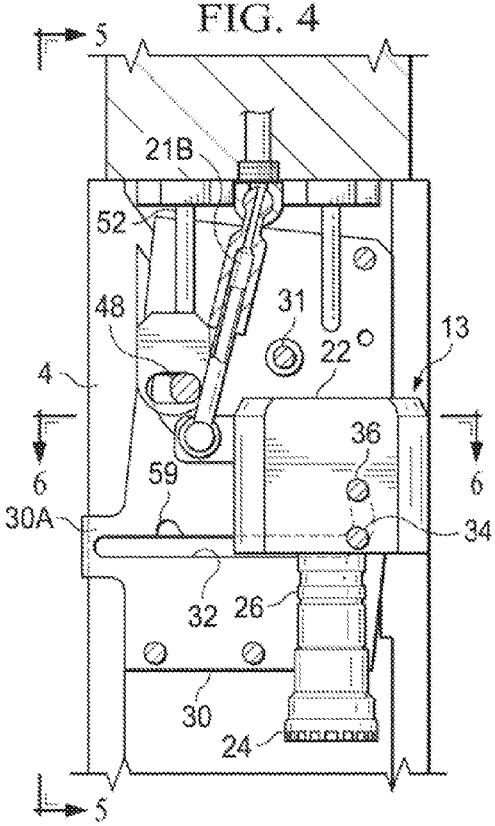
FIG. 4 is a schematic side view of a portion of the apparatus shown in FIG. 1.
Figure 5:
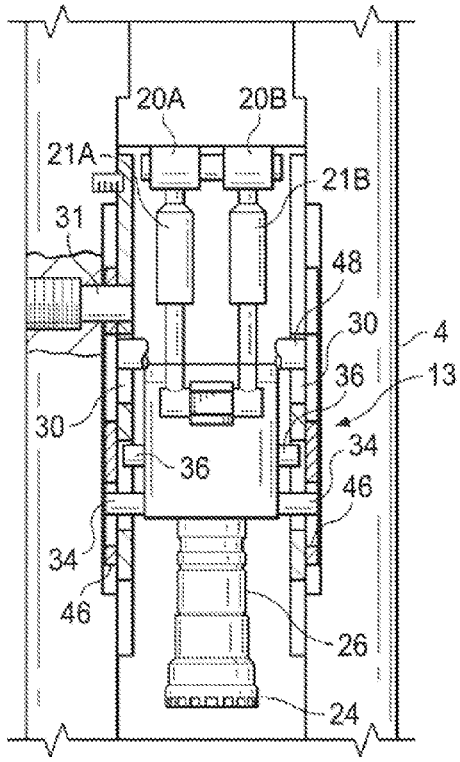
FIG. 5 is a schematic rear view of a portion of the apparatus shown in FIG. 1.
Figure 6:
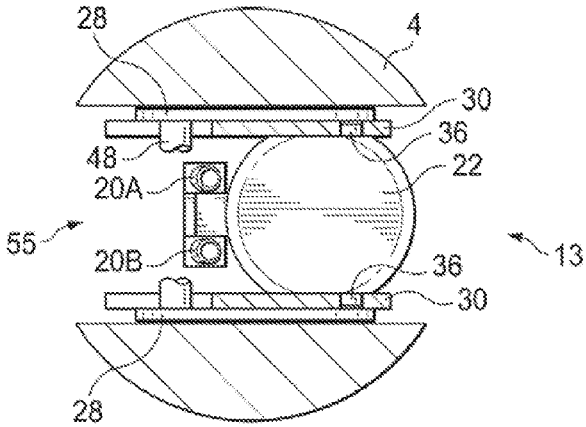
FIG. 6 is a schematic sectional top view of a portion of the apparatus shown in FIG. 1.

As also shown in FIGS. 3B and 4, the longer leg of the J-slot 32 may extend almost to the outer perimeter of the housing 4, such as may increase mechanical advantage during repositioning of the hydraulic coring motor 22. For example, the fixed plate 30 may include an extension 30A projecting radially away from the main or remaining portion of the fixed plate 30, perhaps to or even slightly beyond the housing 4, such that the J-slot 32 may extend further towards the side of the housing 4. In other embodiments within the scope of the present disclosure, however, the extension 30A of the fixed plate 30 may not radially extend up to the side of the housing 4, but may instead be completely enveloped by the housing 4. Nonetheless, it is clear that variations from the illustrated embodiment (e.g., an L-shaped slot, differently sized extension 30A, no extension 30A, etc.) also fall within the scope of the present disclosure.

Figure 7:
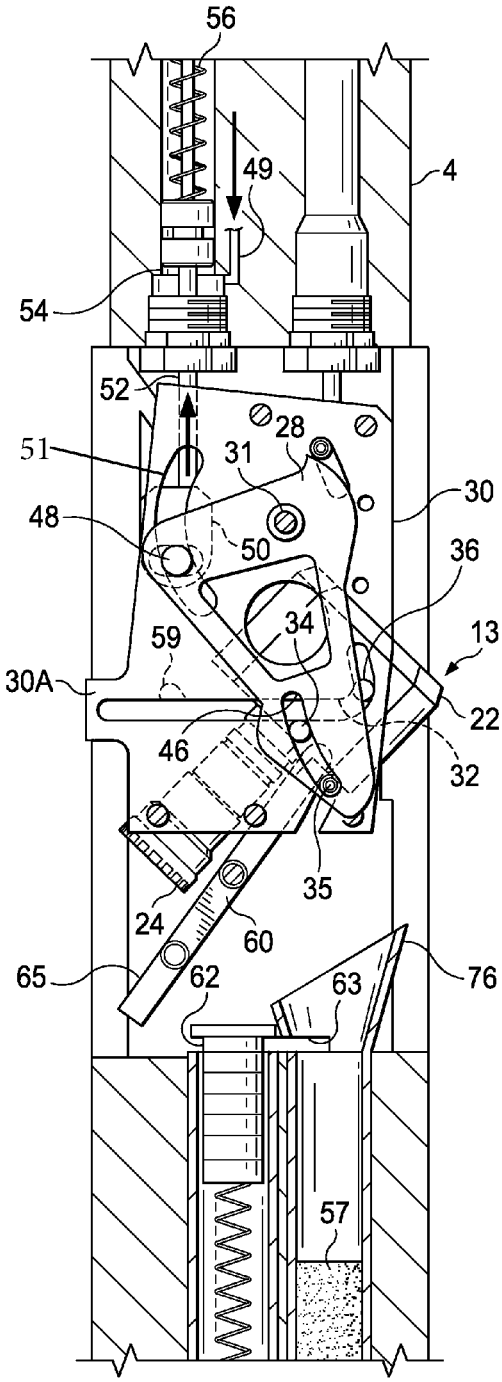
FIGS. 7-10 are schematic sectional side views of a portion of the apparatus shown in FIG. 1 in various operational positions.
Figure 8:
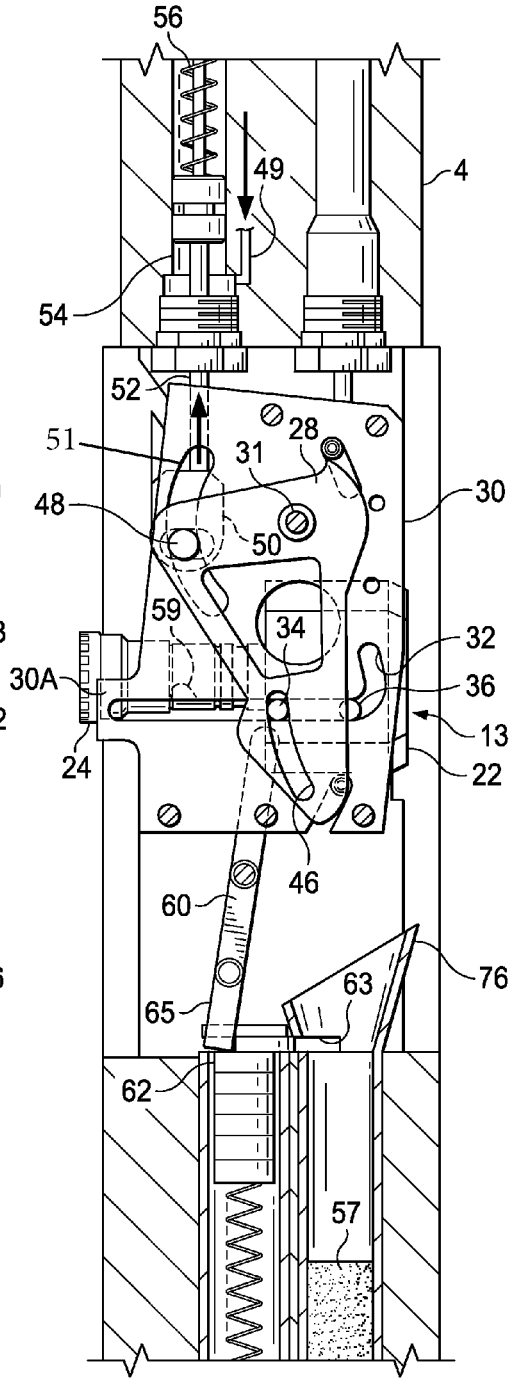

As FIGS. 7 and 8 illustrate, if the pins 34, 36 were driven along the J-shaped slot 32 from its shorter leg to the end of its longer leg, the hydraulic coring motor 22 would be rotated through 90 degrees and pushed forward toward the formation 9. This is accomplished by a drive mechanism that includes a pair of drive plates 28, each of which lies between one of the fixed plates 30 and the housing 4. Each of the drive plates 28 is pivoted about a pin 31 near one of its vertices. A slot 46 near a second vertex of each drive plate 28 engages each pin 34. The pin 34 ("leading pin") is longer than the pin 36 ("follower pin") so that it may extend through both the J-slot 32 of the fixed plate 30 and the slot 46 on the drive plate 28. A member 48 extends through arcuate slots 51 of the fixed plates 30 and between the two drive plates 28 near the third vertex of each and is coupled by a yoke 50 at its midpoint to a ram 52 in a hydraulic cylinder 54, which may be selectively pressurized. The hydraulic cylinder 54 extends axially in the housing 4, and may have a pressure inlet 49 for connection to a hydraulic line.

Referring to FIGS.3B, 4, 7 and 8, as the ram 52 retracts into the cylinder 54, the drive plates 28 are pivoted about the pivot pins act as cams, thereby pushing the leading pin 34 along the J-shaped slot 32 to rotate the hydraulic coring motor 22 to a radial position. Sliding fittings 21A, 21B on the inlets of the lines 20A, 20B to the hydraulic coring motor 22 accommodate this motion. After the core drilling mechanism 13 has been rotated (e.g., by about 90 degrees) to the radial position by retraction of the ram 52 into the hydraulic cylinder 54, further upward movement of the ram 52 causes forward movement of the core drilling mechanism 13 radially outward from an opening 55 in the housing into engagement with the sidewall 6A of the borehole 6. At or prior to reaching the radial position, the shaft of the hydraulic coring motor 22 is rotated (by a system described below), causing the coring bit 24 to drill a core 57 as the pins 34, 36 move toward the longer leg of the J-slot 32.

Figure 9:
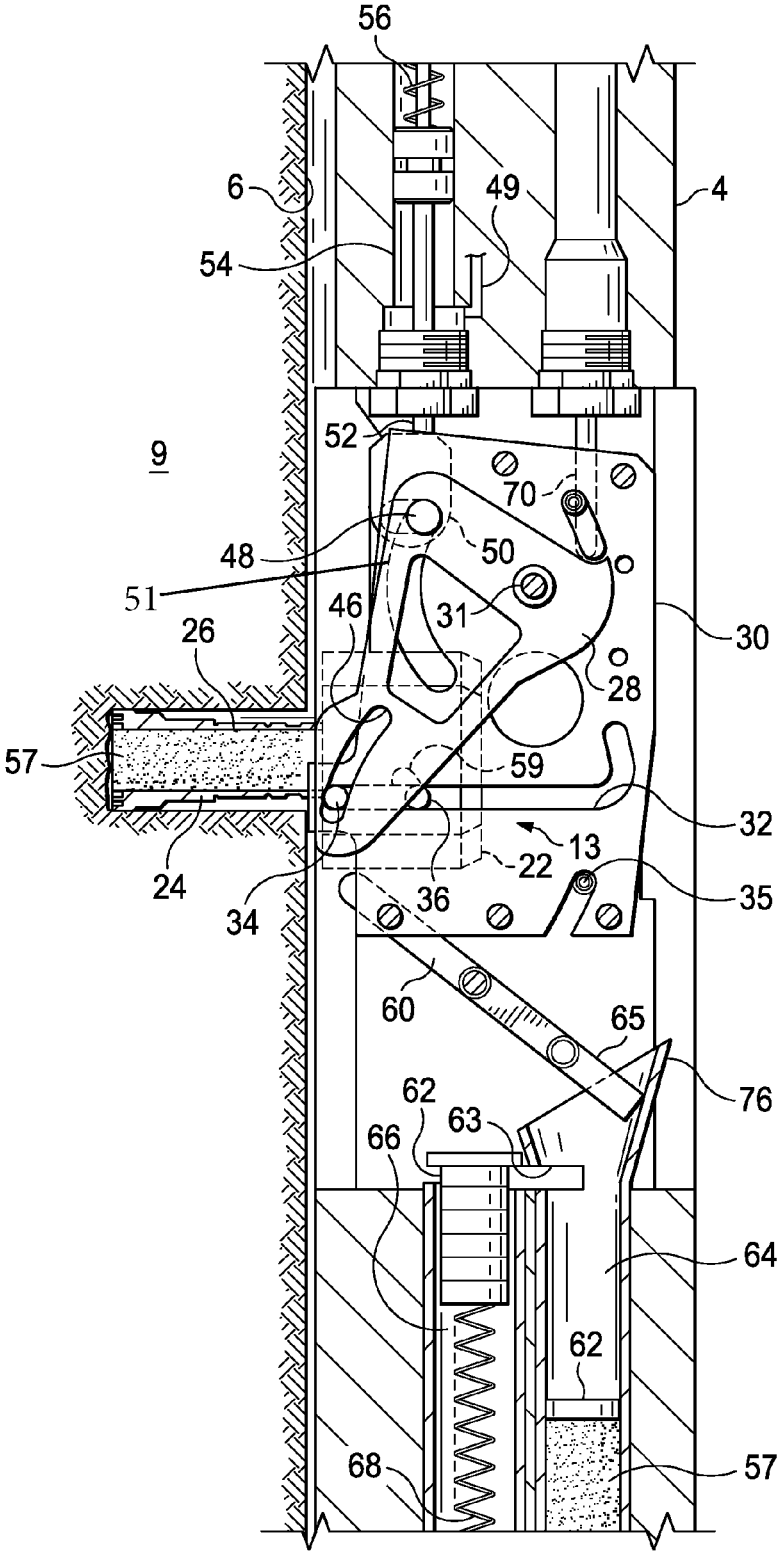

Referring to FIG. 9, the follower pins 36 move into position adjacent a pair of notches 59 extending upward from the longer leg of the J-slot 32, when the leading pins 34 reach the ends of the J-slots 32. Then, continued upward movement of the hydraulic ram 52 generates a lifting force, which moves member 48 upward within the arcuate slots 51 of each fixed plate 30 so that the follower pins 36 are raised up into the notches 59 to tilt the core drilling mechanism 13. The coring bit 24 thereby severs the core 57 by levering the core at its front edge. To prevent the longer, leading pin 34 from jamming in the notch 59 and obstructing forward movement of the hydraulic coring motor 22, the notch 59 may not extend through the full thickness of the plate 30, but instead perhaps only far enough to accommodate the follower pin 36. Of course, other means for severing the core 57 from the formation 9 are also within the scope of the present disclosure. For example, the fixed plates 30 may only be fixed kinematically while the pins 34/36 travel along a substantial portion of the J-slots 32, but may rotate about additional pivots 35 once the pins 34/36 near or reach the end of the J-slots 32. Of course, other means for severing the core 57 from the formation 9 are also within the scope of the present disclosure.

Figure 10:
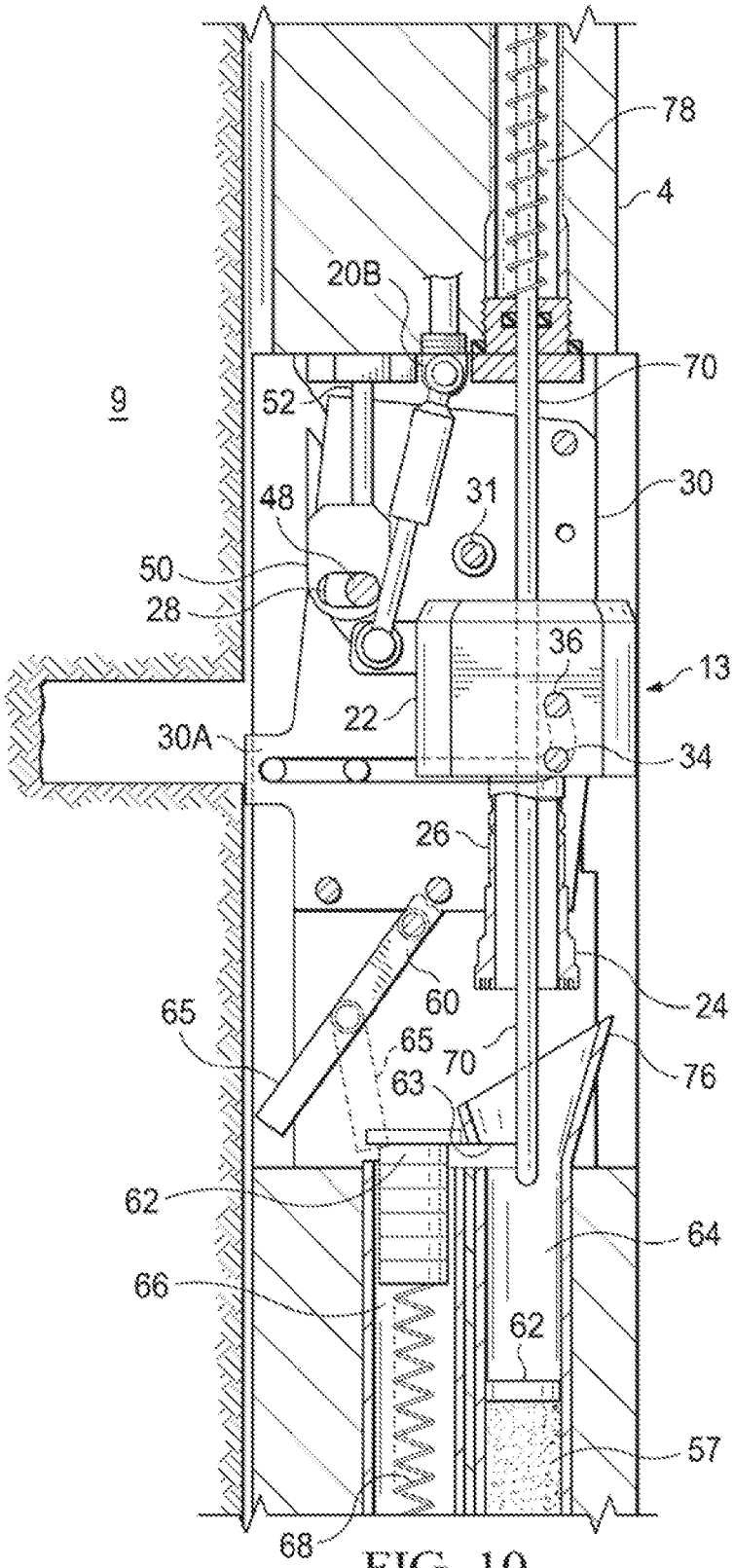

Referring to FIG. 10, after the core 57 has been severed, the core drilling mechanism 13 is retracted and returned to its axial position by extension of the ram 52 as the cylinder 54 is pressurized. A return spring 56 inside the cylinder 54 may exist to, for example, ensure that the core drilling mechanism 13 will be retracted even if the hydraulic system fails. After the core drilling mechanism 13 reaches the axial position, a core pusher rod 70 is extended through the core drilling mechanism 13 by a piston 72 in a hydraulic cylinder 74, thereby pushing the core 57 out of the core-retaining sleeve 26 and into a funnel-like guide 76 which conducts the core into a cylindrical core storage chamber 64. The anchoring shoe 14 may then be retracted to allow the coring tool apparatus 2 to travel through the borehole 6 once more, such as to another coring operation position within the borehole 6.

The core storage chamber 64 is axially disposed within a lower portion 77 of the housing 4 (shown in FIG. 1). A spring 78 in the cylinder 74 may exist to, for example, bias the piston 72 in a manner intended to encourage the removal of the core pusher rod 70 from the core drilling mechanism 13, should the hydraulic system fail to do so.

Referring to FIGS. 2, 3B and 7-10, while the hydraulic coring motor 22 moves forward to drill the core, its leading edge pushes a kicker rod 60 that is pivoted to the housing 4. A kicker foot 65 extends transversely from the rod 60 to kick a core marker disk 62 through a guide slot 63 in the funnel 76 and into the core storage chamber 64 to separate and mark successively drilled, cores 57. The core marker disks 62, which can be manufactured of any suitable material which will not deteriorate under typical borehole conditions or damage the core samples, are stacked and spring-biased upward in a core marker barrel 66 adjacent to storage chamber 64. A spring 68 (shown in FIG. 9) mounted between the housing 4 and the kicker rod 60 may bias the kicker rod 60 toward its original position. The foot 66 may be hinged to bend as it passes over the core markers 62 as the kicker rod returns, after which it is straightened by, for example, a torsional spring (not shown). Of course, other means for kicking the core markers 62 into the core storage chamber 64 are also within the scope of the present disclosure. For example, instead of the kicker rod/foot 60/65 mechanism, shown in the figures, a selectively actuated hydraulic cylinder may be utilized to position the core markers 62 in the core storage chamber 64.

A coring motor hydraulic circuit (not shown) may drive the hydraulic coring motor 22 with, for example, a pump powered by an electric motor. The coring motor hydraulic circuit, may be housed in an upper portion 81 of the housing 4, as shown in FIG. 1. A positioning drive system hydraulic circuit (not shown), which may also be housed in the upper portion 81 of the housing 4, may drive a downhole pump with a motor, and may also drive the anchoring shoe ram 16, the core pusher piston 72 and the drive plate ram 52. A feedback flow controller may control WOB by, for example, using backpressure in the coring motor circuit to control a needle valve in the line to the drive plate piston. The backpressure may increase as resisting torque from the formation 9 increases, thus slowing down the drive plate piston 52 to slow the forward movement of the drill bit 24. However, other means for controlling WOB are also within the scope of the present disclosure. For example, instead of the above-described feedback flow controller, the coring tool apparatus 2 may include a pressure gauge and a downhole microcontroller to modulate the WOB with an electric solenoid.

In operation, the coring tool apparatus 2 may be lowered into the borehole 6 on a wireline 10, with the anchoring shoe 14 held flush against the housing 4. When the coring tool apparatus 2 reaches the desired depth, a signal from surface causes flow to the anchoring shoe cylinder 18 so as to extend the anchoring shoe 14 outward to hold the coring tool apparatus 2 in the desired position against the formation 9. Subsequent signals may direct flow to the drive plate cylinder 54 to rotate the hydraulic coring motor 22 and move it toward the formation 9. As this occurs, the hydraulic coring motor 22 may be driven by its pump. Forward speed and/or pressure of the hydraulic coring motor 22 as it cuts a core 57 may be controlled by the above-described feedback flow controller or pressure gauge/microcontroller combination. When the core 57 is severed, flow to cylinders 54 and 74 retract the coring motor 22 to its axial position and extend the core pusher rod 70 therethrough to dislodge the core 57 into the core storage chamber 64.

While aspects of the present disclosure may be described in the context of wireline tools, one or more of such aspects may also be applicable to any number and/or type(s) of additional and/or alternative downhole tools, such as drillstring tools and/or coiled tubing tools. One or more aspects of this disclosure may also be used in other coring applications, such as in-line coring.

For example, during drilling operations, once a formation of interest is reached, drillers may investigate the formation and/or its contents through the use of downhole formation evaluation tools. Some example formation evaluation tools (e.g., LWD and MWD tools) may be part of the drillstring used to form the wellbore and may be used to evaluate formations during the drilling process. MWD refers to measuring the drill bit trajectory as well as wellbore temperature and pressure, while LWD refers to measuring formation and/or formation fluid parameters or properties, such as resistivity, porosity, permeability, viscosity, density, phase-change pressure and sonic velocity, among others. Real-time data, such as the formation pressure, may allow decisions about drilling mud weight and composition to be made, as well as decisions about drilling rate and weight-on-bit (WOB) during the drilling process. While LWD and MWD have different meanings to those of ordinary skill in the art, that distinction is not germane to this disclosure, and therefore this disclosure does not distinguish between the two terms. Furthermore, LWD and MWD need not be performed while the drill bit is actually cutting through the formation 9. For example, LWD and MWD may occur during interruptions in the drilling process, such as when the drill bit is briefly stopped, to take measurements, after which drilling resumes. Measurements taken during intermittent breaks in drilling are still considered to be made "while-drilling" because they do not require the drillstring to be removed from the wellbore or tripped.

Other example formation evaluation tools may be used after the wellbore has been drilled or formed and the drillstring removed from the wellbore. These tools may be lowered into a wellbore using a wireline 10 for electronic communication and/or power transmission, and therefore are commonly referred to as wireline tools. In general, a wireline tool may be lowered into a wellbore to measure any number and/or type(s) of formation properties at any desired depth(s). Additionally, or alternatively, a formation evaluation tool may be lowered into a wellbore via coiled tubing.

Figure 11:
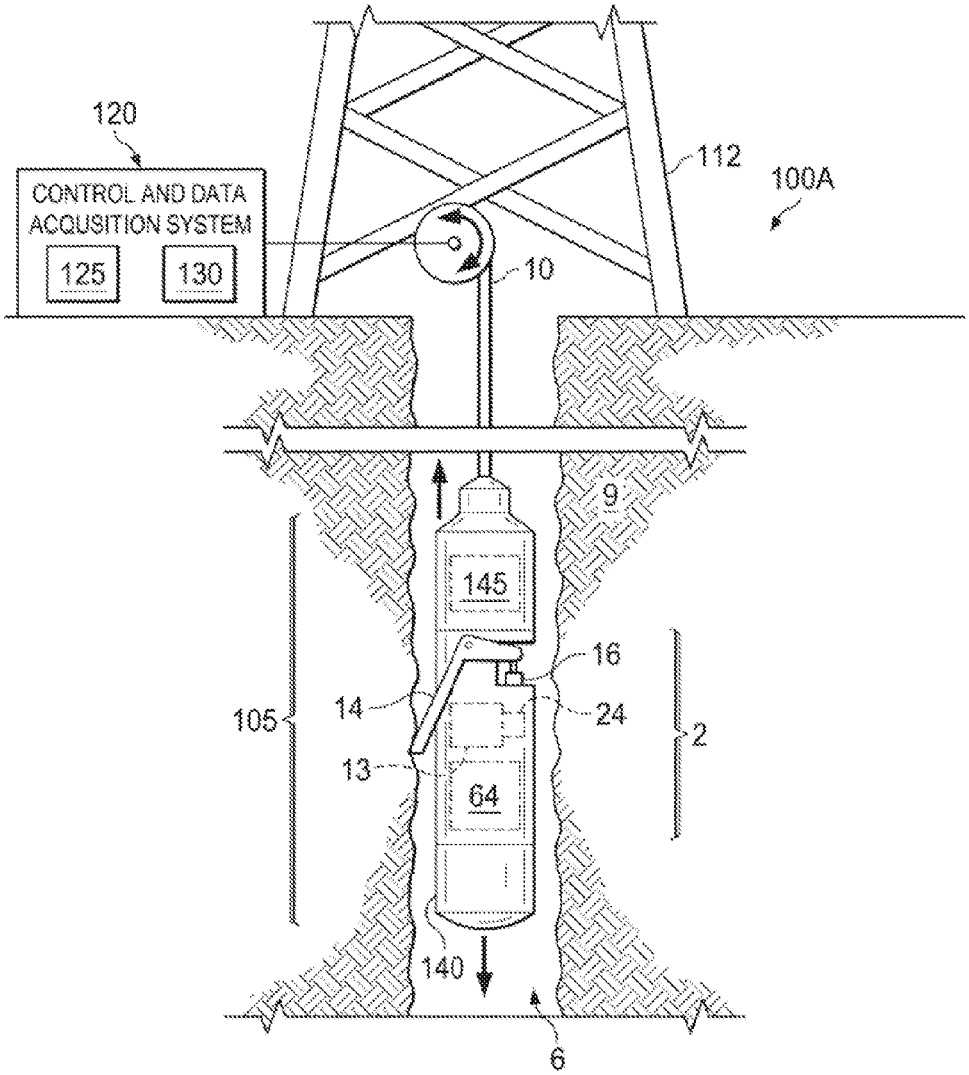
FIG. 11 is a schematic side view of at least a portion of apparatus according to one or more aspects of the present disclosure.

FIG. 11 depicts an example wireline system 100A comprising the coring tool apparatus 2 according to one or more aspects of the present disclosure. The example wireline system 100A of FIG. 11 may be situated onshore (as shown) and/or offshore. The example wireline system 100A may include a wireline assembly 105, which may be configured to extract core samples from the subterranean formation 9 into which a wellbore 6 has been drilled.

The example wireline assembly 105 of FIG. 11 may be suspended from a rig 112 into the wellbore 6. The wireline assembly 105 maybe suspended in the wellbore 6 at the lower end of a multi-conductor cable 10, which may be spooled on a winch (not shown) at the surface. At the surface, the cable 10 may be communicatively and/or electrically coupled to a control and data acquisition system 320. The example control and data acquisition system 120 of FIG. 11 may include a controller 125 having an interface configured to receive commands from a surface operator. The control and data acquisition system 120 may further include a processor 130 configured to control the extraction and/or storage of core samples by the example wireline assembly 105.

The example wireline assembly 105 of FIG. 11 may include a telemetry module 145 along with the coring tool apparatus 2. Although the example telemetry module 145 of FIG. 11 is shown as being implemented separate from the coring tool apparatus 2, the telemetry module 145 may alternatively be implemented integral to or otherwise within the coring tool apparatus 2. Further, additional and/or alternative components, modules and/or tools may also be implemented within the wireline assembly 105.

According to one or more aspects of the present disclosure, the coring tool apparatus 2 is capable of obtaining core samples having larger lengths and/or larger diameters relative to conventional sidewall coring devices. By implementing one or more aspects described above, the stroke length of the core drilling mechanism 13 may be maximized for a given tool diameter. For example, the coring bit 24 may be extended into the formation 9 by a distance of at least about 2.5 inches, and perhaps up to about 3.0 or about 3.5 inches. This larger core length is obtained by elongating the guide slots 32 of the fixed plates 30 to extend as radially outward as possible, perhaps by forming the fixed plates 30 with integral extensions 30A allowing the guide slots 32 to extend even further towards the formation 9.

A large volume core 57 may be advantageous for the evaluation of the formation 9. For example, one of the tests that may be performed on a sample core 57 is a flow test. This test may provide porosity and/or permeability values of the formation 9 from which the core 57 has been obtained. These values are often used together with other formation evaluation data to estimate the amount of hydrocarbon that can potentially be produced from the wellbore 6. However, it should be appreciated that the accuracy of the flow test result is sensitive to the volume of the core sample 57. The core samples 57 that may be collected by the coring tool apparatus 2 according to one or more aspects of the present disclosure may have a length of about 2.5 inches or more, which is an increase over the core samples obtainable using conventional sidewall coring tools, thereby yielding a substantially increased testable volume even after the ends of the core samples 57 are trimmed. By doing so, the results of analyses performed on the core samples 57 may be more accurate, and may provide better estimates of the hydrocarbon reserves.

Additionally, collecting core samples having diameters of at least about 1.5 inches, which is an increase over the cores obtainable using conventional sidewall coring tools, may further increase the core volume by over 100 percent. Moreover, laboratory equipment is typically designed for 1.5 and 2.0 inch diameter cores and, more rarely, for 1.0 inch cores. Thus, core samples obtained using conventional sidewall coring tools may require wrapping or padding in order to properly fit these core samples into test equipment designed for larger diameter cores. In contrast, core samples 57 obtained by the coring tool apparatus 2 according to one or more aspects of the present disclosure may be tested using readily available laboratory equipment without having to apply such wrapping or padding.

While not shown in FIG. 11, the example wireline assembly 105 of FIG. 11 may implement any number and/or type(s) of alternative and/or additional modules and/or tools. Other example modules and/or tools that may be implemented by the wireline assembly 105 include, but are not limited to, a formation testing tool, a power module, a hydraulic module and/or a fluid analyzer module. Some example formation evaluation tools draw fluid(s) from the formation 9 into the wireline assembly 105. As fluid(s) are drawn into the wireline assembly 105, various measurements of the fluid(s) may be performed to determine any number and/or type(s) of formation property (-ies) and conditions), such as the fluid pressure in tire formation 9, the permeability of the formation 9 and/or the bubble point of the formation fluid(s). These and other properties may be important in making formation exploration decisions and/or evaluations. In the present disclosure, the term "formation testing tool" encompasses any downhole tool that draws fluid(s) from the formation 9 into the wireline assembly 105 for evaluation, whether or not the samples are stored. In cases where fluid(s) are captured, sometimes referred to as fluid sampling, fluid(s) may be drawn into a sample chamber and transported to the surface for further analysis (often at a laboratory).

The example telemetry module 145 of FIG. 11 may comprise a downhole control system (not shown) communicatively coupled to the example control and data acquisition system 120. In the illustrated example of FIG. 11, the control and data acquisition system 120 and/or the downhole control system may be configured to control the coring tool apparatus 2.

As also depicted in FIG. 11, the example wireline assembly 105 may include multiple downhole modules and/or tools that are operatively connected together. Downhole tool assemblies often include several modules (e.g., sections of the wireline assembly 105 that perform different functions). Additionally, more than one downhole tool or component may be combined on the same wireline to accomplish multiple downhole tasks during the same wireline run. The modules may be connected by field joints. For example, each module of a wireline assembly may have one type of connector at its top end and a second type of connector at its bottom end. The top and bottom connectors are made to operatively mate with each other. By using modules and/or tools with similar arrangements of connectors, all of the modules and tools may he connected end-to-end to form the wireline assembly 105. A field joint may provide an electrical connection, a hydraulic connection and/or a flowline connection, depending on the requirements of the tools on the wireline. An electrical connection typically provides both power and communication capabilities.

In practice, the wireline tool assembly 105 may include several different components, some of which may include two or more modules (e.g., a sample module and a pump-out module of a formation testing tool). In the present disclosure, the term "module" is used to describe any of the separate and/or individual tool modules that may be connected to implement the wireline assembly 105. The term "module" refers to any part of the wireline assembly 105, whether the module is part of a larger tool or a separate tool by itself. It is also noted that the term "wireline tool" is sometimes used in the art to describe the entire wireline assembly 105, including all of the individual tools that make up the assembly. In the present disclosure, the term "wireline assembly" is used to prevent any confusion with the individual tools that make up the wireline assembly (e.g., a coring module, a formation testing tool and a nuclear magnetic resonance (NMR) tool may all be included in a single wireline assembly).

Figure 12:
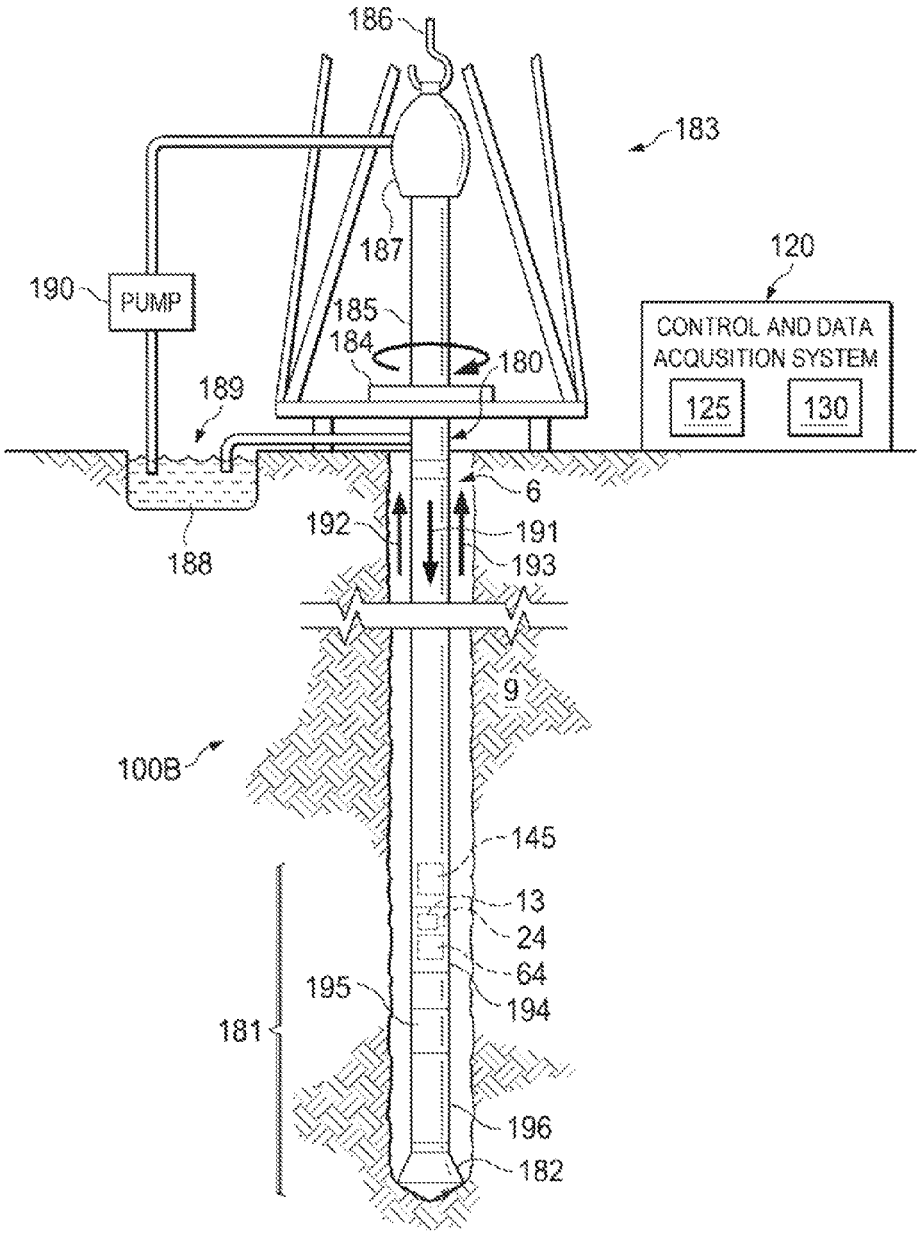
FIG. 12 is a schematic side view of at least a portion of apparatus according to one or more aspects of the present disclosure.

FIG. 12 depicts an example wellsite drilling system 100B according to one or more aspects of the present disclosure, which may be employed onshore (as shown) and/or offshore. In the example wellsite system 100B of FIG. 12, the example borehole 6 is formed in the subsurface formation 9 by rotary and/or directional drilling. A drillstring 180 is suspended within the example borehole 6 and has a bottom hole assembly (BHA) 181 having a drill bit 182 at its lower end. A surface system includes a platform and derrick assembly 183 positioned over the borehole 110. The assembly 183 may include a rotary table 184, a kelly 185, a hook 186 and/or a rotary swivel 187. The drillstring 180 may be rotated by the rotary table 184, energized by means not shown, which engages the kelly 185 at the upper end of the drillstring 180. The example drillstring 180 may be suspended from the hook 186, which may be attached to a traveling block (not shown) and through the kelly 185 and the rotary swivel 187, which permits rotation of the drillstring 180 relative to the hook 186. Additionally, or alternatively, a top drive system may be used.

In the example of FIG. 12, the surface system 100B may also include drilling fluid 188, which is commonly referred to in the industry as mud, stored in a pit 189 formed at the wellsite. A pump 190 may deliver the drilling fluid 188 to the interior of the drillstring 180 via a port (not shown) in the swivel 187, causing the drilling fluid 188 to flow downwardly through the drillstring 180 as indicated by the directional arrow 191. The drilling fluid 188 may exit the drillstring 180 via water courses, nozzles, jets and/or ports in the drill bit 182, and then circulate upwardly through the annulus region between the outside of the drillstring 180 and the wall of the wellbore 110, as indicated by the directional arrows 192 and 193. The drilling fluid 188 may be used to lubricate the drill bit 182 and/or carry formation cuttings up to the surface, where the drilling fluid 188 may be cleaned and returned to the pit 189 for recirculation. It should be noted that in some implementations, the drill bit 182 may be omitted and the bottom hole assembly 181 may be conveyed via coiled tubing and/or pipe.

The example BHA 181 of FIG. 12 may include, among other things, any number and/or type(s) of while-drilling downhole tools, such as any number and/or type(s) of LWD modules (one of which is designated at reference numeral 194), and/or any number and/or type(s) of MWD modules (one of which is designated at reference numeral 195), a rotary-steerable system or mud motor 196, and/or the example drill bit 182. The example LWD module 194 of FIG. 12 is housed in a special type of drill collar, as it is known in the art, and may contain any number and/or type(s) of logging tool(s), measurement tool(s), sensor(s), device(s), formation evaluation tool(s), fluid analysis tool(s) and/or fluid sampling device(s). The example LWD module 194 of FIG. 12 may implement the coring tool apparatus 2 described above. Accordingly, the example LWD module 194 may comprise, among other things, the core drilling mechanism 13, the coring bit 24 and/or the core storage chamber 64, as shown in FIG. 12. The same or different LWD modules may implement capabilities for measuring, processing and/or storing information, as well as the example telemetry module 145 for communicating with the MWD module 195 and/or directly with surface equipment, such as the example control and data acquisition system 120. While a single LWD module 194 is depicted in FIG. 12, it will also be understood that more than one LWD module may be implemented.

The example MWD module 195 of FIG. 12 may be housed in a special type of drill collar and contain one or more devices for measuring characteristics of the drillstring 180 and/or the drill bit 182. The example MWD tool 195 may also include an apparatus (not shown) for generating electrical power for use by the downhole system 181. Example devices to generate electrical power include, but are not limited to, a mud turbine generator powered by the flow of the drilling fluid, and a battery system. Example measuring devices include, but are not limited to a WOB measuring device, a torque measuring device, a vibration measuring device, a shock measuring device, a stick/slip measuring device, a direction measuring device and an inclination measuring device. Additionally, or alternatively, the MWD module 195 may include an annular pressure sensor and/or a natural gamma ray sensor. The MWD module 195 may also include capabilities for measuring, processing and storing information, as well as for communicating with the control and data acquisition system 120. For example, the MWD module 195 and the control and data acquisition system 120 may communicate information either way (i.e., uplink and downlink) using any past, present or future two-way telemetry system such as a mud-pulse telemetry system, a wired drillpipe telemetry system, an electromagnetic telemetry system and/or an acoustic telemetry system, among others. The example control and data acquisition system 120 of FIG. 12 may also include the example controller 125 and/or the example processor 130 discussed above in connection with FIG. 11.

In view of all of the above, those skilled in the art will appreciate that the present disclosure introduces an apparatus comprising: a coring tool apparatus having a housing for conveyance within a borehole extending into a subterranean formation, the coring tool apparatus comprising: a core drilling mechanism for cutting cores from a sidewall of the borehole, wherein the core drilling mechanism comprises a hydraulic coring motor having a hollow shaft from which a coring bit on the end of a core-retaining sleeve extends, and wherein the coring bit is to cut a core of at least about 1.5 inches in diameter and at least about 2.5 inches in length; a pair of support plates each fixed to the housing and comprising a guide slot having a longer leg and a shorter leg, wherein the longer leg extends substantially perpendicular to a central axis of the coring tool apparatus, and wherein the shorter leg extends from the longer leg at an angle ranging between about 70 degrees and about 110 degrees relative to the longer leg; a pair of leading pins each extending from the hydraulic coring motor into the guide slot of a corresponding one of the support plates, and a pair of follower pins each extending from the hydraulic coring motor into the guide slot of a corresponding one of the support plates, such that when the leading and follower pins are driven along their respective guide slots, the hydraulic coring motor is rotated about 90 degrees and then pushed toward the subterranean formation adjacent the coring tool apparatus; a pair of drive plates each positioned between the housing and a corresponding one of the support plates, wherein each drive plate comprises a slot and is pivoted about a pivot pin near one of its vertices, wherein the leading and follower pins each extend into the guide slot of the corresponding support plate, and wherein the leading pins each further extend into the slot of the corresponding drive plate; and a hydraulic cylinder coupled at least indirectly to the drive plates. wherein actuation, of the hydraulic cylinder pivots the drive plates, thereby pushing the leading pins along the guide slots to rotate the hydraulic coring motor to a radial position and then urge the hydraulic coring motor towards the subterranean formation. The coring tool apparatus may further comprise: a member extending between the drive plates near a vertex of each drive plate; a ram extending from the hydraulic cylinder; and a yoke coupling the ram to the member such that as the ram retracts into the hydraulic cylinder; the drive plates act as cams and pivot about their pivot pins, thereby pushing the leading pins along the guide slots to rotate the hydraulic coring motor and then urge the coring bit into the subterranean formation.

The coring tool apparatus may be coupled to a means for conveyance within the borehole. The conveyance means may comprise at least one of a wireline and a drillstring.

The coring tool apparatus may further comprise an anchoring mechanism disposed partially within the housing to secure the coring tool apparatus at a desired position relative to the borehole. The anchoring mechanism may comprise an L-shaped anchoring shoe pivotally attached at its vertex to the coring tool apparatus for movement toward and away from a side of the housing opposite the core drilling mechanism. The anchoring shoe may lie Hush against the housing while the coring tool apparatus travels through the borehole. The anchoring shoe may be pivoted to an extended position by an additional hydraulic ram coupled thereto. The apparatus may further comprise a spring biasing the anchoring shoe towards a retracted position.

The follower pins may each extend through the guide slot of the corresponding support plate but not through the slot of the corresponding drive plate.

The coring bit may be or comprise an annulus-shaped bit at least partially comprising diamond.

When the follower pins are at the ends of the shorter legs of the guide slots, the coring bit may point in a direction generally parallel with the central axis of the coring tool apparatus.

The longer legs of the guide slots may extend to points proximate an outer perimeter of the housing.

Each of the support plates may comprise an extension projecting radially away from a remaining portion of the support plate. Each of the guide slots may extend into the extension of the corresponding support plate to the side of the housing.

The coring tool apparatus may further comprise sliding fittings on inlets of hydraulic lines connected to the hydraulic coring motor.

Each of the support plates may further comprise a notch extending from the longer leg of the guide slot, such that when the leading pins reach the end of the longer legs of the corresponding guide slots, continued retraction of the hydraulic cylinder ram urges the follower pins into the notches, thus tilting the cote drilling mechanism to sever a drilled core from the subterranean formation.

The coring tool apparatus may further comprise; a core storage chamber; and a core pusher rod extendable through the core drilling mechanism to push an obtained core out of the core drilling mechanism and into the core storage chamber. The coring tool apparatus may further comprise a funnel-like guide aligning an obtained core being pushed out of the core drilling mechanism with the core storage chamber. The coring tool apparatus may further comprise a kicker rod pivoted to the housing such that movement of the hydraulic coring motor towards the subterranean formation causes the kicker rod to kick a core marker disk into the core storage chamber to separate and mark successively obtained cores.

The present disclosure also introduces an apparatus comprising a coring tool apparatus having a housing for conveyance within a borehole extending into a subterranean formation. The coring tool apparatus may comprise; a core drilling mechanism comprising a coring bit and a hydraulic coring motor to drive the coring bit, wherein the coring bit is to cut a core of at least about 1.5 inches in diameter and at least about 3.0 inches in length; a pair of support plates each coupled to the housing and comprising a guide slot having at least a portion extending substantially perpendicular to a central axis of the coring tool apparatus; a pair of leading pins each extending from the hydraulic coring motor into the guide slot of a corresponding one of the support plates, and a pair of follower pins each extending from the hydraulic coring motor into the guide slot of a corresponding one of the support plates, such that when the leading and follower pins are driven along their respective guide slots, the hydraulic coring motor is rotated relative to the housing and then pushed toward the subterranean formation adjacent the coring tool apparatus; a pair of drive plates each positioned between the housing and a corresponding one of the support plates, wherein each drive plate comprises a slot, wherein the leading and follower pins each extend into the guide slot of the corresponding support plate, and wherein the leading pins each further extend into the slot of the corresponding drive plate; and a hydraulic cylinder coupled at least indirectly to the drive plates, wherein actuation of the hydraulic cylinder pivots the drive plates, thereby pushing the leading pins along the guide slots to rotate the hydraulic coring motor relative to the housing and then urge the hydraulic coring motor towards the subterranean formation. The coring bit may be to cut a core of at least about 3.5 inches in length. The coring tool apparatus may be coupled to a means for conveyance within the borehole, wherein the conveyance means may comprise at least one of a wireline and a drillstring. The coring tool apparatus may further comprise; a core storage chamber; and a core pusher rod extendable through the core drilling mechanism to push an obtained core out of the core drilling mechanism and into the core storage chamber.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to comply with 37 C.F.R. §1.72(b) to allow the reader to quickly ascertain the nature of the technical disclosure. It is submitted with the understanding that it will not be used to interpret or limit the scope or meaning of the claims.

What is claimed is:

1. An apparatus, comprising:

a coring tool apparatus having a housing for conveyance within a borehole extending into a subterranean formation, the coring tool apparatus comprising:

a core drilling mechanism for cutting cores from a sidewall of the borehole, wherein the core drilling mechanism comprises a hydraulic coring motor having a hollow shaft from which a coring bit on the end of a core-retaining sleeve extends;

a pair of support plates each fixed to the housing and each comprising an arcuate slot and a guide slot having a longer leg and a shorter leg, wherein the longer leg extends substantially perpendicular to a central axis of the coring tool apparatus;

a pair of leading pins each extending from the hydraulic coring motor into the guide slot of a corresponding one of the support plates, and a pair of follower pins each extending from the hydraulic coring motor into the guide slot of a corresponding one of the support plates;

a pair of drive plates each positioned between the housing and a corresponding one of the support plates, wherein each drive plate comprises a slot and is pivoted about a pivot pin wherein the leading pins each extend into the slot of the corresponding drive plate; and a hydraulic cylinder coupled at least indirectly to the pair of drive plates by a member extending through the arcuate slot of each corresponding support plate and extending between the pair of drive plates, wherein actuation of the hydraulic cylinder moves the member upward within the arcuate slot of each corresponding support plate to pivot the drive plates.

2. The apparatus of claim 1 wherein the coring tool apparatus further comprises:

a ram extending from the hydraulic cylinder; and a yoke coupling the ram to the member.

3. The apparatus of claim 1 wherein the coring tool apparatus is coupled to a means for conveyance within the borehole, wherein the conveyance means comprises at least one of a wireline and a drillstring.

4. The apparatus of claim 1 wherein the coring tool apparatus further comprises an anchoring mechanism disposed partially within the housing to secure the coring tool apparatus at a desired position relative to the borehole.

5. The apparatus of claim 4 wherein the anchoring mechanism comprises an L-shaped anchoring shoe pivotally attached to the coring tool apparatus for movement toward and away from a side of the housing opposite the core drilling mechanism.

6. The apparatus of claim 5 wherein the anchoring shoe lies flush against the housing while the coring tool apparatus travels through the borehole.

7. The apparatus of claim 5 wherein the anchoring shoe is pivoted to an extended position, by an additional hydraulic ram coupled thereto.

8. The apparatus of claim 1 wherein the follower pins each extend through the guide slot of the corresponding support plate but not through the slot of the corresponding drive plate.

9. The apparatus of claim 1 wherein the coring bit is or comprises an annulus-shaped bit at least partially comprising diamond.

10. The apparatus of claim 1 wherein, the shorter leg extends from the longer leg at an angle ranging between about 70 degrees and about 110 degrees relative to the longer leg.

11. The apparatus of claim 1 wherein the longer legs of the guide slots extend to points proximate an outer perimeter of the housing.

12. The apparatus of claim 1 wherein each of the support plates comprises an extension projecting radially away from a remaining portion of the support plate.

13. The apparatus of claim 12 wherein each of the guide slots extend into the extension of the corresponding support plate to the side of the housing.

14. The apparatus of claim 1 wherein the coring tool apparatus further comprises sliding fittings on inlets of hydraulic lines connected to the hydraulic coring motor.

15. The apparatus of claim 1 wherein the coring tool, apparatus further comprises:

a core storage chamber; and a core pusher rod extendable through the core drilling mechanism to push an obtained core out of the core drilling mechanism and into the core storage chamber.

16. The apparatus of claim 15 wherein the coring tool apparatus further comprises a funnel-like guide aligning an obtained core being pushed out of the core drilling mechanism with the core storage chamber.

17. An apparatus, comprising:

a coring tool apparatus having a housing for conveyance within a borehole extending into a subterranean formation, the coring tool apparatus comprising:

a core drilling mechanism comprising a coring bit and a hydraulic coring motor to drive the coring bit, wherein the coring bit is to cut a core of at least about 1.5 inches in diameter and at least about 3.0 inches in length;

a pair of support plates each coupled to the housing and comprising an arcuate slot a guide slot having at least a portion extending substantially perpendicular to a central axis of the coring tool apparatus;

a pair of leading pins each extending from the hydraulic coring motor into the guide slot of a corresponding one of the support plates, and a pair of follower pins each extending from the hydraulic coring motor into the guide slot of a corresponding one of the support plates, a pair of drive plates each positioned between the housing and a corresponding one of the support plates, wherein each drive plate comprises a slot, wherein the leading and follower pins each extend into the guide slot of the corresponding support plate, and wherein the leading pins each further extend into the slot of the corresponding drive plate; and a hydraulic cylinder coupled at least indirectly to the drive plates by a member extending through the arcuate slot of each corresponding support plate and between the pair of drive plates, wherein actuation of the hydraulic cylinder moves the member upward within the arcuate slot of each corresponding support plate to pivot the drive plates, thereby pushing the leading pins along the guide slots to rotate tire hydraulic coring motor relative to the housing and then urge the hydraulic coring motor towards the subterranean, formation.

18. The apparatus of claim 17 wherein the coring bit is to cut a core of at least about 3.5 inches in length.

19. The apparatus of claim 17 wherein the coring tool apparatus is coupled to a means for conveyance within the borehole, wherein the conveyance means comprises at least one of a wireline and a drillstring.

20. The apparatus of claim 17 wherein the coring tool apparatus further comprises:

a core storage chamber; and a core pusher rod extendable through the core drilling mechanism to push an obtained core out of the core drilling mechanism and into the core storage chamber.

* * * * *